US010106981B2

(12) United States Patent
Kopish et al.

(10) Patent No.: US 10,106,981 B2
(45) Date of Patent: Oct. 23, 2018

(54) GLASS AND SOLID WALL PANEL SYSTEM

(71) Applicant: Krueger International, Inc., Green Bay, WI (US)

(72) Inventors: Andrew J. Kopish, Green Bay, WI (US); Timothy John LaFleur, Menasha, WI (US); Nathan A. Quintal, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 15/492,547

(22) Filed: Apr. 20, 2017

(65) Prior Publication Data

US 2017/0314262 A1 Nov. 2, 2017

Related U.S. Application Data

(60) Provisional application No. 62/328,086, filed on Apr. 27, 2016.

(51) Int. Cl.
*E04B 2/74* (2006.01)
*E04C 1/42* (2006.01)
(Continued)

(52) U.S. Cl.
CPC ..... *E04B 2/7455* (2013.01); *E04B 2/7453* (2013.01); *E04B 2/7457* (2013.01); *E04C 1/42* (2013.01); *E04B 2/7818* (2013.01); *E04B 2002/749* (2013.01); *E04B 2002/7461* (2013.01); *E04B 2002/7462* (2013.01); *E06B 1/366* (2013.01)

(58) Field of Classification Search
CPC .... E04B 2/7453; E04B 2/7455; E04B 2/7457; E04B 2/7424; E04B 2/7422; E04B 2/7435; E04B 2/7448; E04B 2002/7462; E04B 2002/7461; E04B 2/7863; E04B 2/789; E04C 1/42
See application file for complete search history.

(56) References Cited

U.S. PATENT DOCUMENTS 3,436,887 A * 4/1969 Grossman ..... E04B 2/965 52/235
3,745,732 A 7/1973 Pritchard et al.
(Continued)

FOREIGN PATENT DOCUMENTS

DE 4100493 7/1991
GB 486052 5/1938
(Continued)

*Primary Examiner* — Adriana Figueroa
*Assistant Examiner* — Jessie T Fonseca
(74) *Attorney, Agent, or Firm* — Andrus Intellectual Property Law, LLP

(57) ABSTRACT

A wall system includes a panel having a lower end, a panel assembly having an upper end, and a transition beam positioned between the panel and the panel assembly. The transition beam couples to the upper end of the panel assembly, and the transition beam defines a channel that receives the lower end of the panel to thereby couple the transition beam to the panel. The panel assembly includes a cladding panel having a rail projection, and the transition beam defines an engagement channel that receives the rail projection such that the cladding panel couples to the transition beam.

11 Claims, 13 Drawing Sheets

(51) Int. Cl.
*E06B 1/36* (2006.01)
*E04B 2/78* (2006.01)

(56) References Cited

U.S. PATENT DOCUMENTS

| | | | | |
|---|---|---|---|---|
| 4,458,464 | A | 7/1984 | Borghetto | |
| 4,916,876 | A | 4/1990 | Schuyler | |
| 5,036,637 | A * | 8/1991 | Biebuyck | E04B 2/96 52/204.591 |
| 6,158,179 | A * | 12/2000 | Ackerly | E04B 2/745 52/126.3 |
| 7,114,299 | B2 | 10/2006 | Ringness | |
| 8,151,527 | B2 * | 4/2012 | Gosling | E04B 2/7425 52/238.1 |
| 8,820,721 | B1 | 9/2014 | Poma et al. | |
| 9,127,504 | B2 | 9/2015 | Sprague | |
| 2010/0095615 | A1 * | 4/2010 | Houle | E04B 2/7448 52/264 |
| 2014/0191175 | A1 | 7/2014 | Bertato | |
| 2016/0348361 | A1 * | 12/2016 | Gosling | E04B 2/745 |

FOREIGN PATENT DOCUMENTS

| | | |
|---|---|---|
| GB | 1118992 | 7/1968 |
| GB | 2365882 | 2/2002 |
| WO | 9946454 | 9/1999 |

* cited by examiner

GLASS AND SOLID WALL PANEL SYSTEM

BACKGROUND

The present disclosure generally relates to wall systems. More specifically, the present disclosure relates to wall systems that include glass panels and opaque panel assemblies.

SUMMARY

This Summary is provided to introduce a selection of concepts that are further described herein below in the Detailed Description. This Summary is not intended to identify key or central features of the claimed subject matter, nor is it intended to be used as an aid in limiting the scope of the claimed subject matter.

In certain examples, a wall system includes a panel having a lower end, a panel assembly having an upper end, and a transition beam positioned between the panel and the panel assembly. The transition beam couples to the upper end of the panel assembly, and the transition beam defines a channel that receives the lower end of the panel.

In certain examples, a wall system includes a first panel having an upper end, a lower end opposite the upper end, a first side end, and a second side end opposite the first side end; a first panel assembly having an upper end, a first side end, and a second side end opposite the first side end; and a first transition beam coupled to the upper end of the first panel assembly and defines a channel that receives the lower end of the first panel. A first transition column couples to the first transition beam and defines a channel that receives the first side end of the first panel. A second transition column is spaced apart from the first transition column and couples to the first transition beam. The second transition column defines a channel that receives the second side end of the first panel. A terminal column couples to the first transition column and the first side end of second panel to define a terminal end of the wall system.

BRIEF DESCRIPTION OF THE DRAWINGS

The present disclosure is described with reference to the following Figures. The same numbers are used throughout the Figures to reference like features and like components.

DETAILED DISCLOSURE

Through research and experimentation, the inventors have developed improved wall systems 1 that include a plurality of panels 3 (e.g. transparent glass panels) and a plurality of panel assemblies 8 (e.g. assemblies that include opaque cladding panels).

Figure 1:
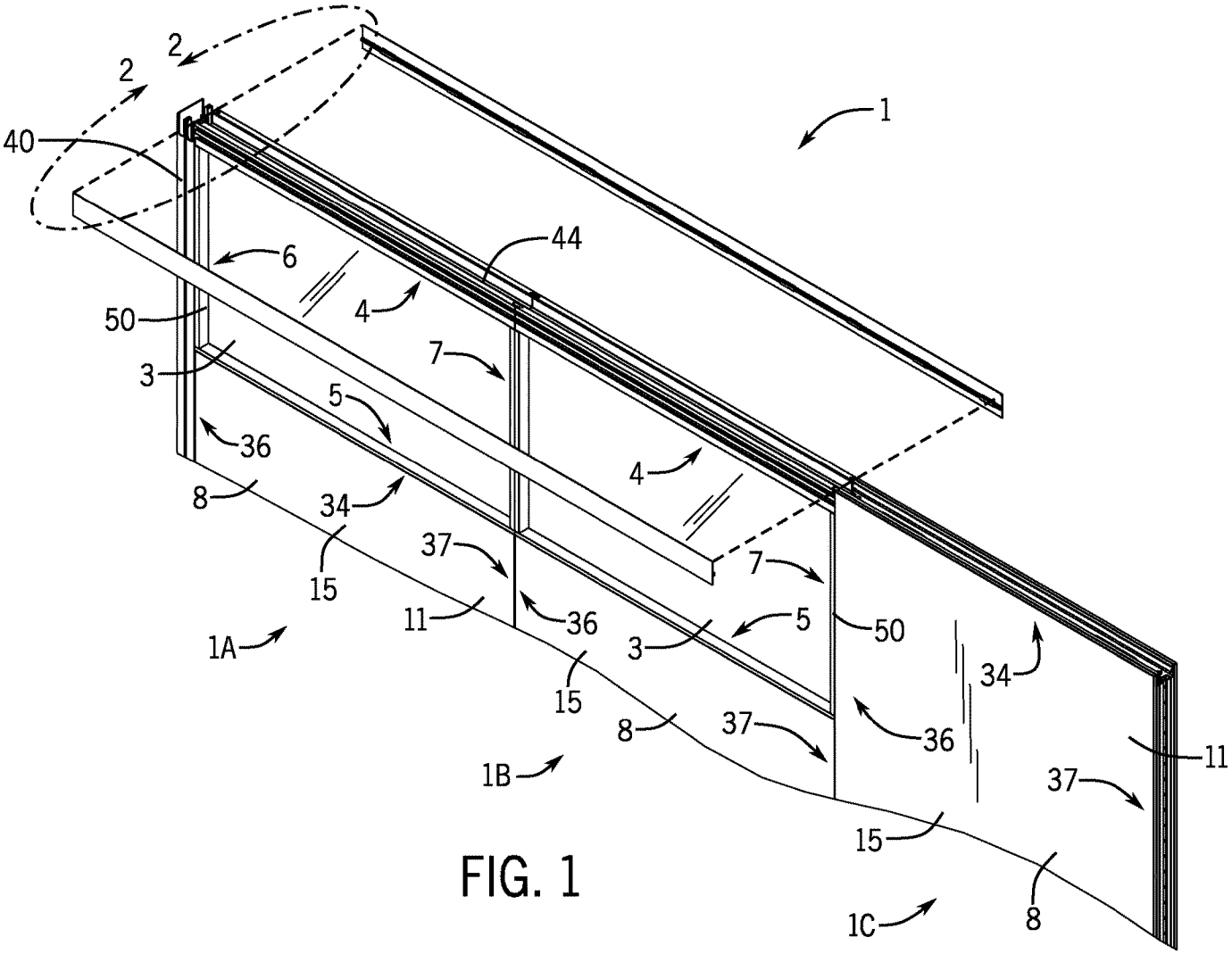
FIG. 1 is a partial perspective view of a wall system of the present disclosure.
Figure 2:
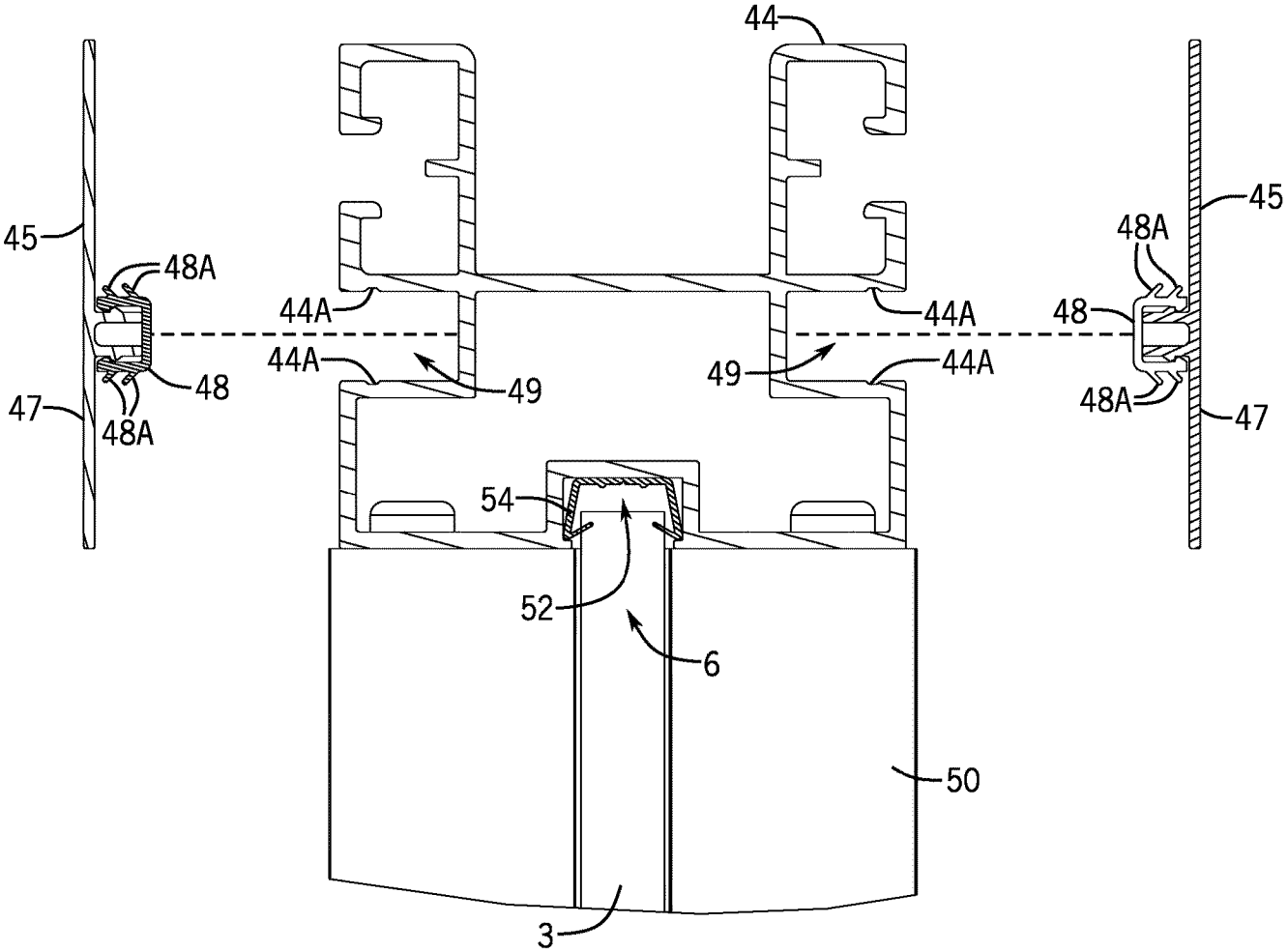
FIG. 2 is a partial cross sectional view of FIG. 1 within line 2-2.
Figure 3:
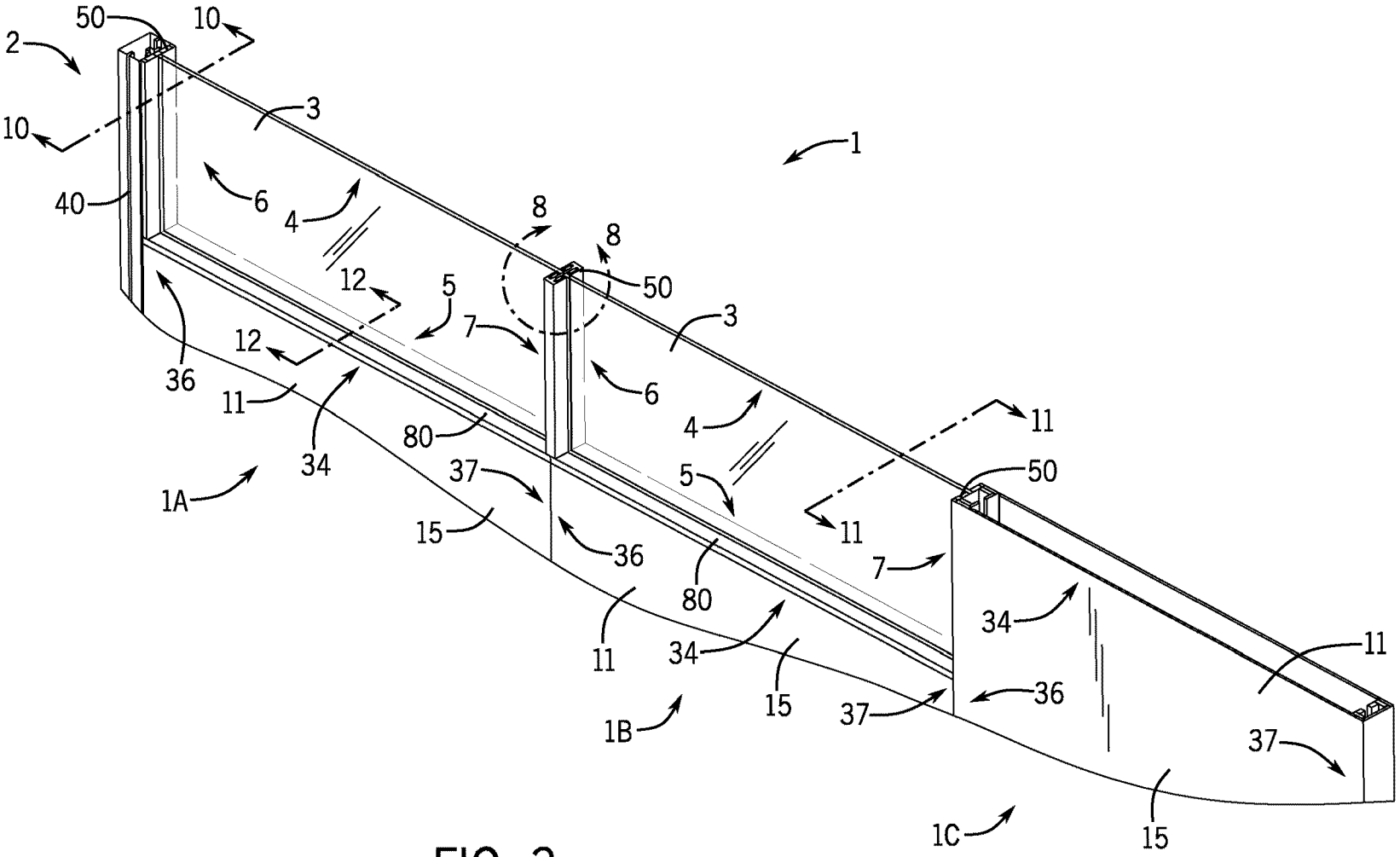
FIG. 3 is a partial perspective view of the wall system of FIG. 1 with a cap removed.
Figure 4:
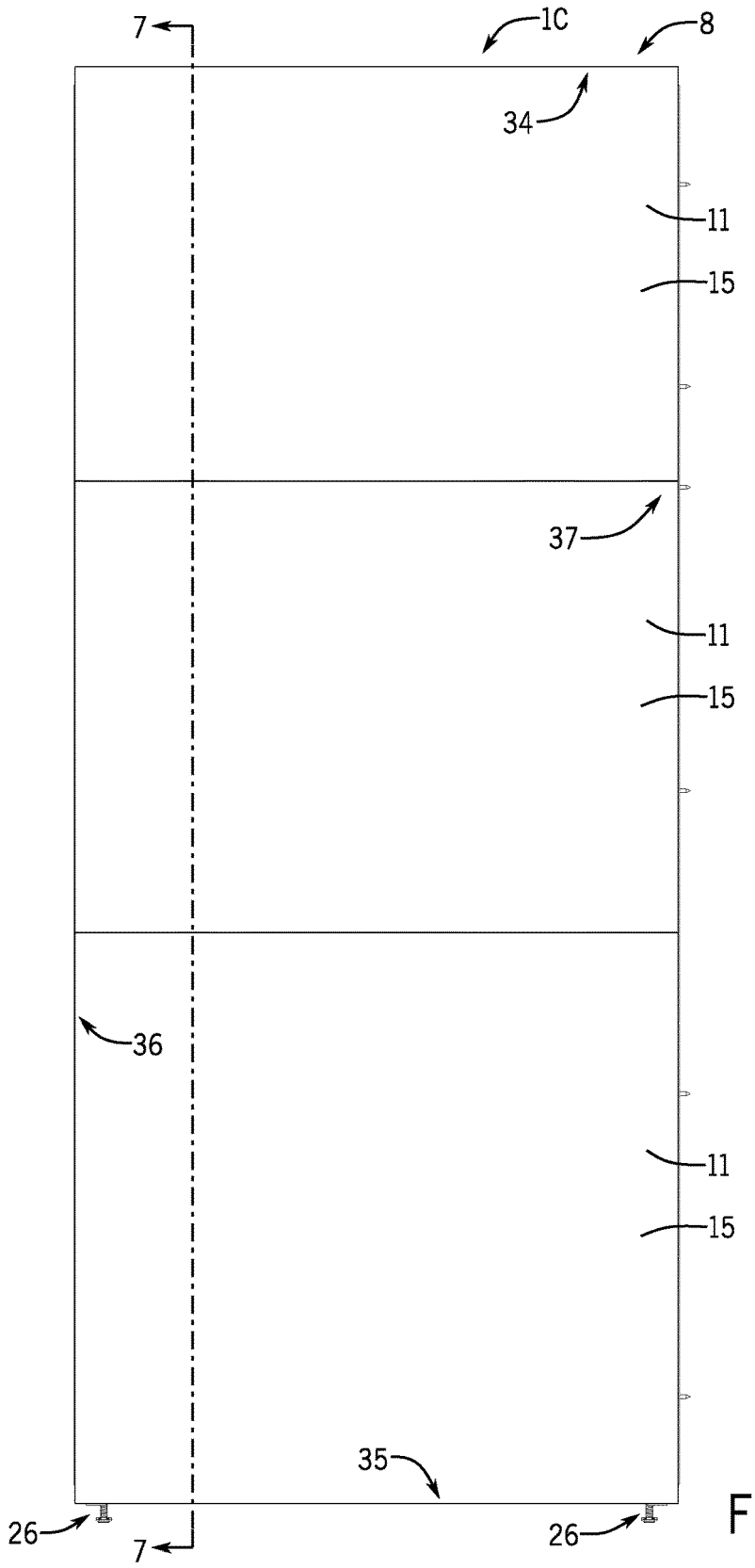
FIG. 4 is a front view of a panel assembly.

Referring to FIGS. 1-3, an exemplary wall system 1 includes a first section 1A that has a first panel 3 stacked on top of a first panel assembly 8, a second section 1B adjacent to the first section 1A that has second panel 3 stacked on top of a second panel assembly 8, and a third section 1C adjacent to the second section 1B and opposite the first section 1A that has a third panel assembly 8. The layout and the orientation of the wall system 1 can vary.

The panels 3 are transparent or semi-transparent and can be made of any suitable material (e.g. plastic or glass panels), while the panel assemblies 8 (described herein) are generally opaque. The size and shape of the panels 3 can vary. In the exemplary embodiment, the panel 3 includes an upper end 4, a lower end 5 opposite the upper end 4, a first side end 6, and a second side end 7 opposite the first side end 6.

Referring to FIGS. 4-7, each panel assembly 8 includes at least one cladding panel 11 coupled to and supported by a sub-structure 16 (described further therein). Each cladding panel 11 includes rail members 12 having rail projections 13 extending therefrom. The rail members 12 can be positioned at any location on the cladding panels (e.g. the rail members 12 are perimetral), and the rail projections 13 can be continuous or intermittent along the length of rail members 12. Adjacent cladding panels 11 can be coplanar with each other. The size and shape of the cladding panels 11 can vary. Any number of cladding panels 11 can be coupled to the sub-structure 16, and the shape and/or size of the sub-structure 16 corresponds to the shape, size, and/or number of the cladding panels 11. In the exemplary embodiment depicted in FIG. 4, the cladding panels 11 are coupled to both sides of the sub-structure 16. In other exemplary embodiments, the cladding panels 11 are coupled to one side of the sub-structure 16. The cladding panels 11 can be made of any suitable material (e.g. fabric, solid surface material, metal, ceramic). In the exemplary embodiment shown in FIG. 3, the panel assembly 8 includes an upper end 34, a lower end 35 opposite the upper end 34, a first side end 36, and a second side end 37 opposite the first side end 36.

Figure 5:
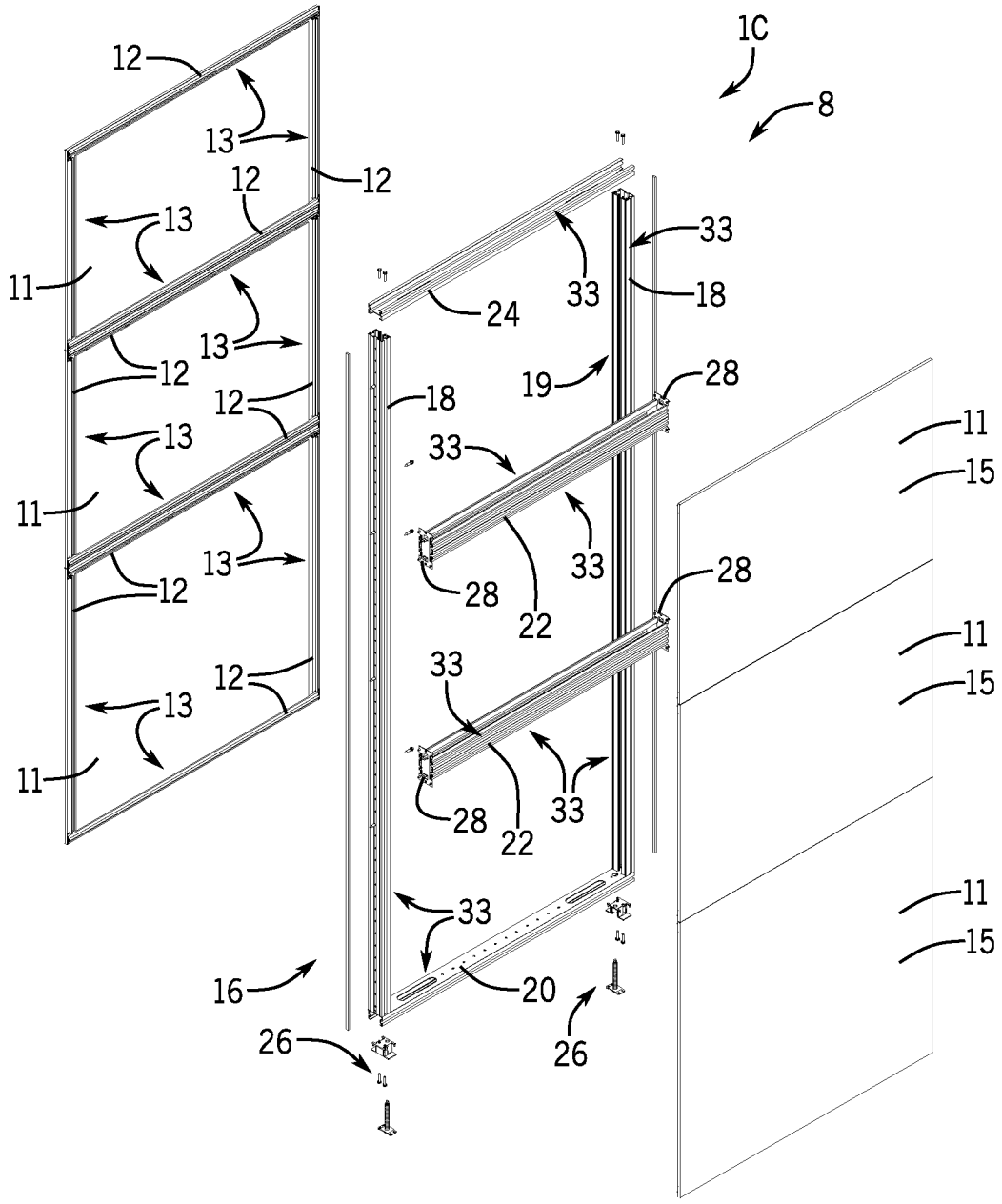
FIG. 5 is an exploded view of panel assembly of FIG. 4.
Figure 6:
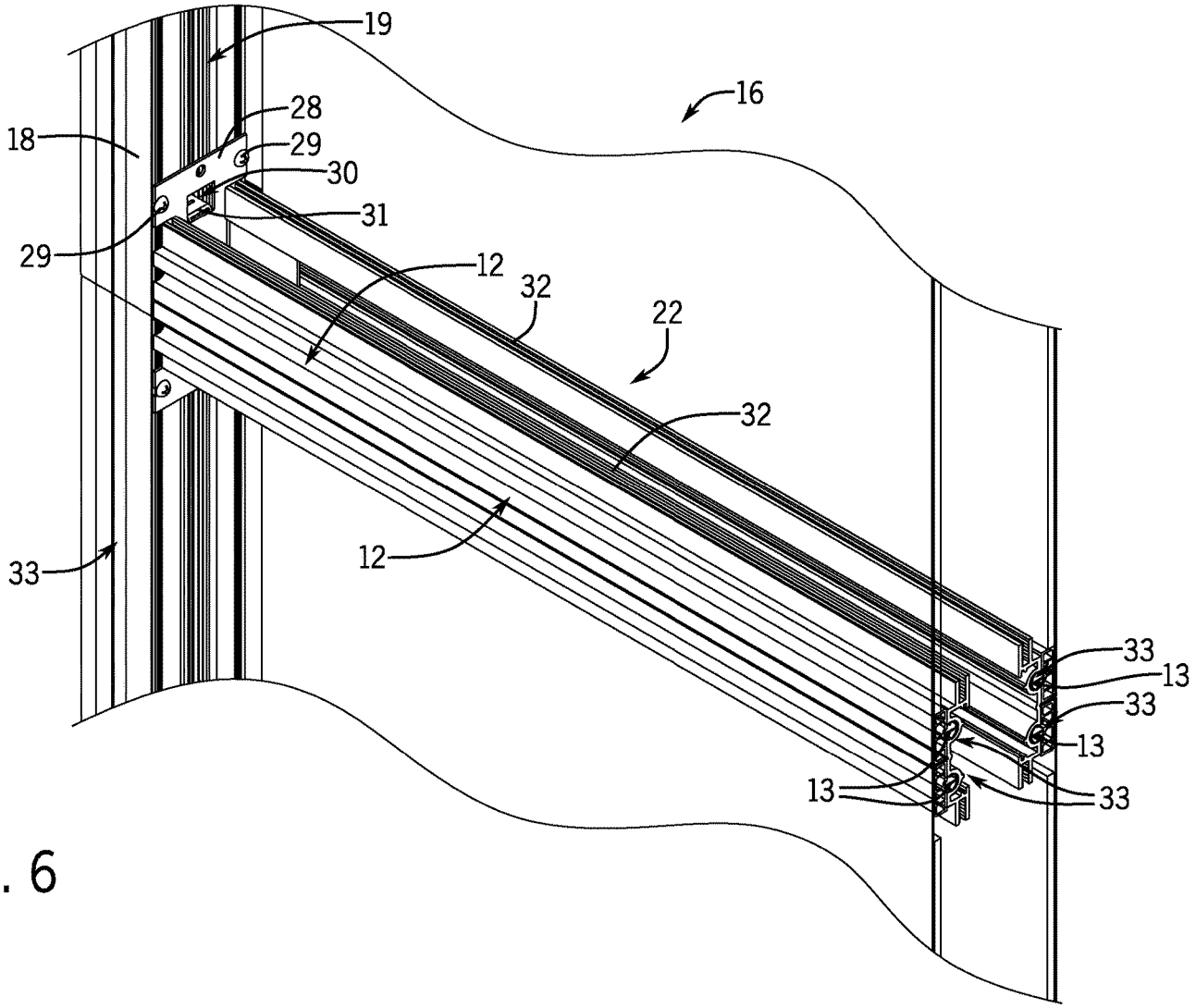
FIG. 6 is an enlarged view of an example cross support.
Figure 7:
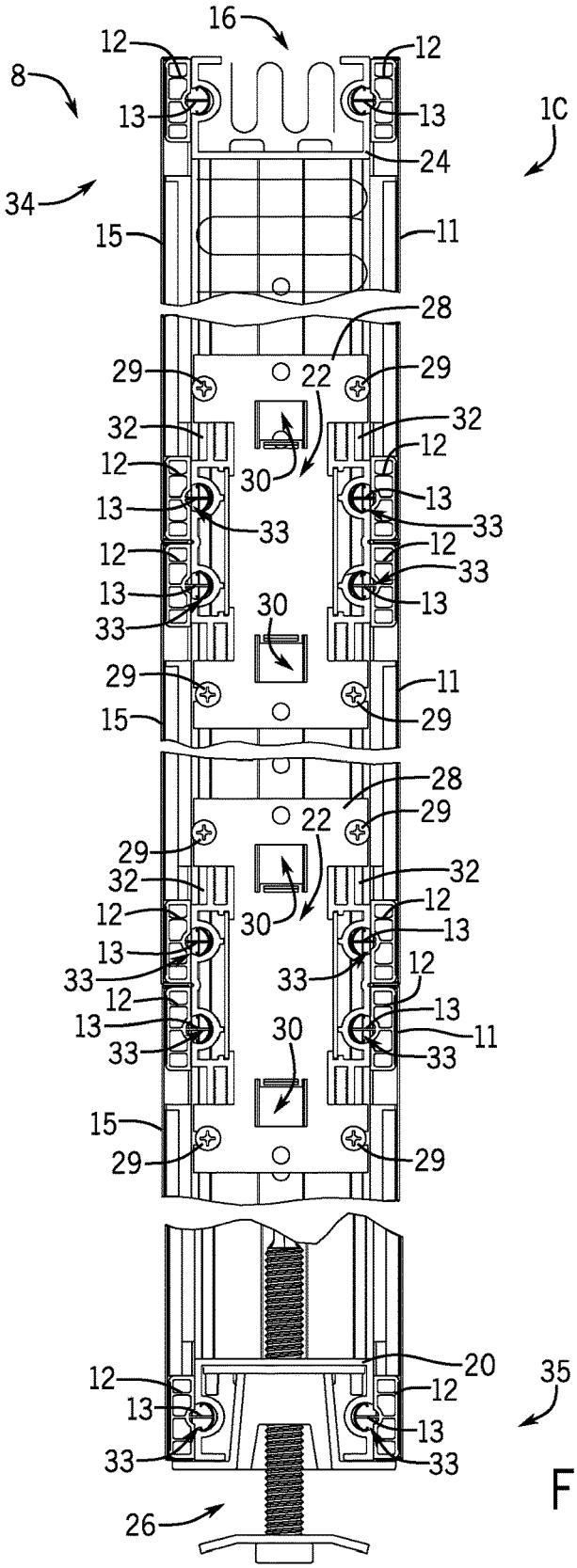
FIG. 7 is a partial cross sectional view of FIG. 4 along line 7-7.

Referring to FIG. 5, the sub-structure 16 includes a pair of spaced columns 18, a lower cross support 20, an upper cross support 24, and at least one intermediate cross support 22 positioned between the lower cross support 20 and the upper cross support 24. The cross supports 20, 22, 24 are coupled to the columns 18 at any location along the columns 18 (i.e. the cross supports 20, 22, 24 can be positioned along the columns 18 to accommodate cladding panels 11 with different heights). As shown in FIG. 6, each of the cross supports 20, 22, 24 has at least one end plate 28 that securely attaches to one of the columns 18 via at least one connector 29 (e.g. screw). The end plate 28 defines at least one opening 30 and a bent tab 31. The bent tab 31 is received in a notch 19 defined by the columns 18 to thereby position the cross support 20, 22, 24 along the columns 18. Each cross support 20, 22, 24 has at least one mounting profile 32 that defines an open space configured to allow electrical wires or other cables (not shown) to pass through the sub-structure 16 and the panel assembly 8.

The cross supports 20, 22, 24 and the columns 18 define engagement channels 33 that correspond to the rail projections 13 of the cladding panels 11 (as described above). The engagement channels 33 are configured to receive the rail projections 13 such that the cladding panels 11 are securely coupled to the sub-structure 16, cross supports 20, 22, 24, and/or the columns 18. The rail projections 13 are configured to elastically deform as the rail projections 13 are received in the engagement channels 33. The shape of the rail projection 13 can vary, and in the embodiment depicted (see FIG. 6) the rail projection 13 has a semi-circular, cylindrical shape (i.e. a semi-circle profile) that extends the length of the rail member 12.

The sub-structure 16 includes at least one height adjustment assembly 26 configured to selectively adjust a distance between the bottom of the lower cross support 20 and an underlying support surface (e.g. concrete floor) (not shown).

Referring back to FIGS. 1-3, the wall system 1 includes a terminal column 40 that defines a terminal end 2 of the wall system 1. The terminal column 40 couples to the panel 3, the panel assembly 8, and/or a transition column 50 (described herein). In the exemplary embodiment, the terminal column 40 couples to the first section 1A of the wall system 1. The terminal column 40 is configured to vertically support and protect the panels 3, panel assemblies 8, and/or the transition columns 50. The terminal column 40 can define engagement channels 33 that correspond to the rail projections 13 of the cladding panels 11 (similar to the engagement channels 33 described with respect to the sub-structure 16 above). In exemplary embodiments, the engagement channels 33 of the terminal column 40 receive rail projections 13 of the cladding panels 11 such that the cladding panels 11 are securely coupled to terminal column 40.

The wall system 1 includes a cap 44 coupled to an upper end 4 of the panels 3 and/or panel assemblies 8 (note that FIGS. 1-2 depicts the wall system 1 with the cap 44 and FIG. 3 depicts the wall system 1 without the cap 44). The cap 44 can extend to cover multiple upper ends 4 of multiple panels 3 and/or panel assemblies 8, and the cap 44 can include features and/or components that allow the cap 44 to couple to other vertically stacked panels, panel assemblies, and/or a support structure (e.g. a wall, ceiling). The cap 44 can be made from any suitable material such as glass, metal, ceramic, plastic, and/or the like. The cap 44 is covered by at least one cap cover 45 that is configured to couple to the cap 44. The cap cover 45 includes a finished surface 47 that provides an aesthetically pleasing appearance. Each cap cover 45 has a clip 48 configured to engage a receiver 49 defined by the cap 44 such that the cap cover 45 is coupled to the cap 44. That is, the clip 48 has at least one elastic projection 48A that elastically deforms and is received in a groove 44A defined by the cap 44 such that the cap cover 45 is coupled to the cap 44. As shown in FIG. 3, the wall system 1 includes the transition column 50 that is disposed between side ends 6, 7 of adjacent panels 3 (e.g. between the panel 3 of the first section 1A and the panel 3 of the second section 1B). The transition column 50 is configured to couple adjacent panels 3 to each other and support the adjacent panels 3. The transition columns 50 can also increase the aesthetic appearance of the joint between adjacent panels 3.

Figure 8:
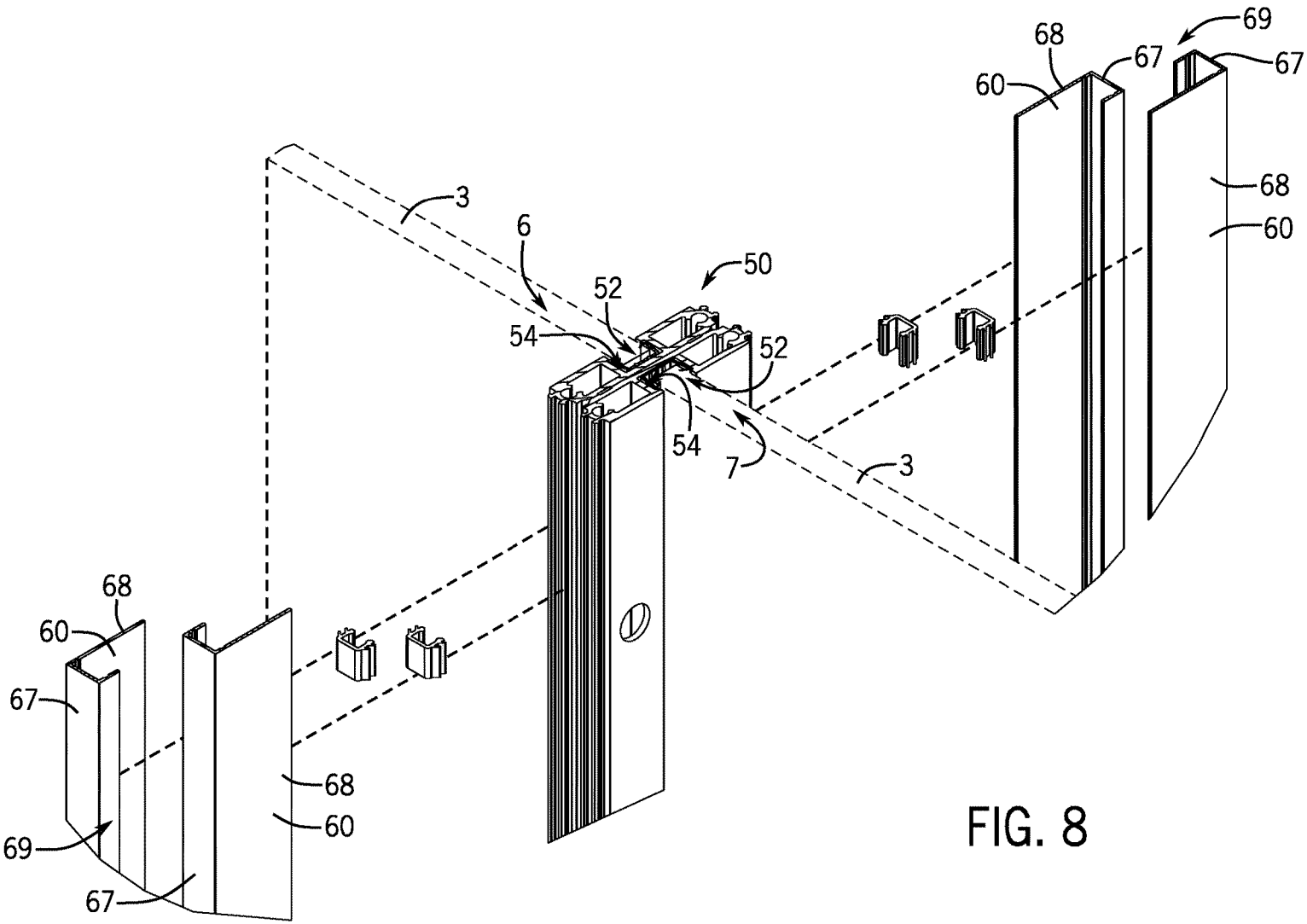
FIG. 8 is an enlarged top exploded view within line 8-8 of FIG. 3 (note transparent panels shown in dashed lines)
Figure 9:
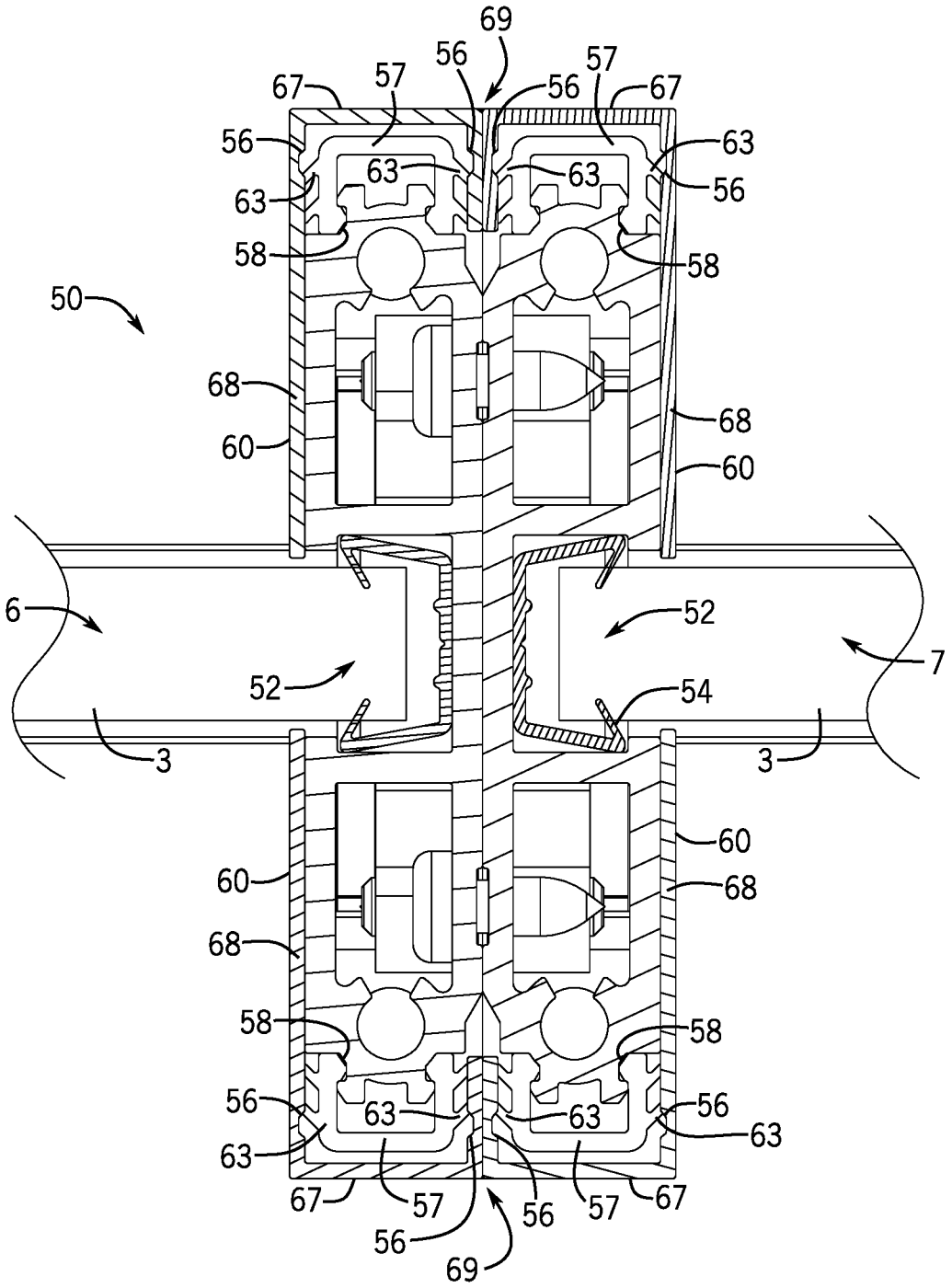
FIG. 9 is an alternative exemplary embodiment like FIG. 7.

Referring to FIGS. 8-9, in one non-limiting exemplary embodiment of the transition column 50, the column is formed by a pair of support beams 51 each defining one of a pair of channels 52 of the combined transition column 50. The channels 52 are opposite each other and configured to slidably receive the side ends 6, 7 of the panels 3, respectively. The shape and number of the channels 52 can vary (e.g. the channels 52 are U-shaped), and the channels 52 can be shaped and/or configured to accommodate varying angles between adjacent panels 3. The transition column 50 can include gaskets 54 that are received in the channels 52 and configured to couple with the side ends 6, 7 of the panels 3. The gaskets 54 are configured to support and protect the panels 3. Inclusion of the gaskets 54 accommodates machining variances and/or tolerances inherent with the transition column 50 and/or the panels 3. The gaskets 54 frictionally and/or slidably couple to the panels 3. Persons of ordinary skill in the art will recognize that the gaskets 54 and/or the transition column 50 can be coupled to panels 3 by mechanical fasteners, adhesive, and/or the like. In certain embodiments, the transition column 50 is coupled to and supported by a transition beam 80 (described further herein).

The wall system 1 includes a pair of covers 60 that each couple to the transition column 50 to thereby cover and protect the transition column 50. Each cover 60 is positioned on opposite sides of the panels 3 and are each configured to increase the aesthetics of the wall system 1. The shape of the cover 60 can vary (e.g. the cover 60 can be U-shaped or L-shaped), and the cover 60 can be coupled to the pair of support beams 51 that combine to form the transition column 50 by sliding the cover 60 over the transition column 50, friction, a "snap-fit" connection, adhesives, mechanism connections, and/or the like. The cover 60 includes an end surface 67 and a pair of opposing side surfaces 68.

The wall system 1 includes retention clips 57 that are configured to be received in and/or engage with channels 58 defined by the transition column 50 and couple the covers 60 to the transition column 50. In operation, the retention clips 57 are positioned onto the transition column 50 such that the retention clips 57 engage with and/or "snap" into the channels 58 to thereby couple the retention clips 57 to the transition column 50. The retention clips 57 includes at least one elastic projection 63 that elastically deforms and is received in a groove 56 defined by the cover 60 such that the cover 60 is coupled (i.e. "snap-fits") to the retention clips 57.

Figure 10:
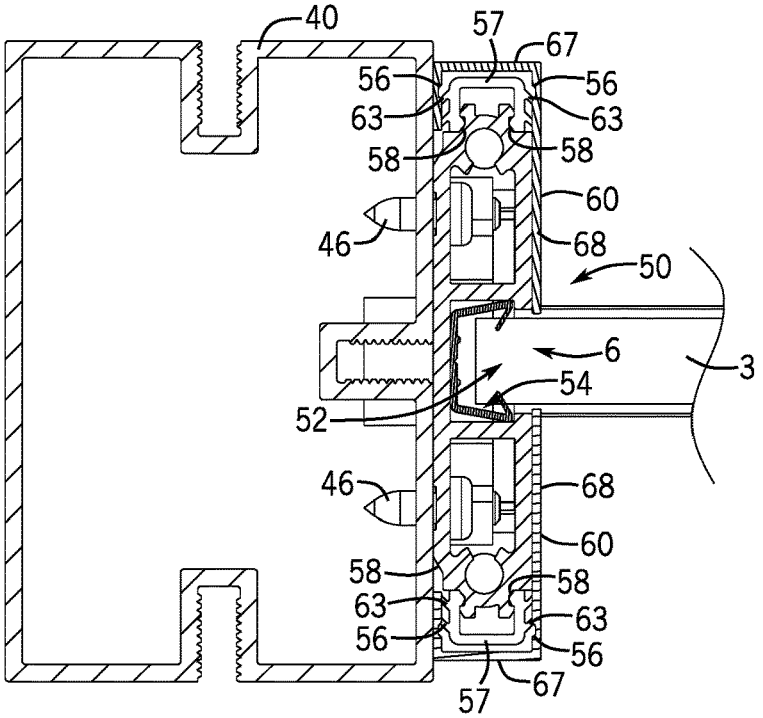
FIG. 10 is a cross sectional view along line 10-10 of FIG. 3 showing a transition column coupled to a terminal column.

Referring to FIG. 10, another exemplary embodiment of the transition column 50 that includes a single support beam 51 that defines the single channel 52 is depicted coupled to the terminal column 40 via at least one connector 46. The type of connector 46 can vary (e.g. the connector 46 can be self-tapping screw or a screw received by a treaded connection (not shown) of the terminal column 40.

Figure 11:
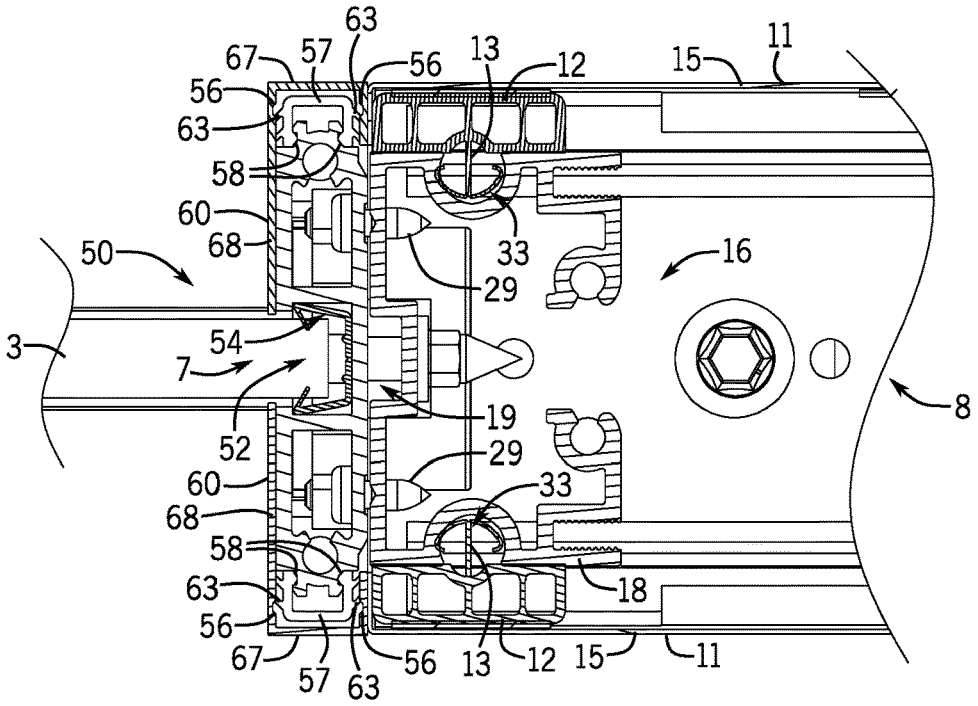
FIG. 11 is a cross sectional view along line 11-11 of FIG. 3 showing a transition column coupled to a column of a panel assembly.

Referring to FIG. 11, another exemplary embodiment of the transition column 50 that includes the single support beam 51 that defines the single channel 52 is depicted coupled to the column 18 of the sub-structure 16 of the panel assembly 8 via at least one connector 46.

Figure 12:
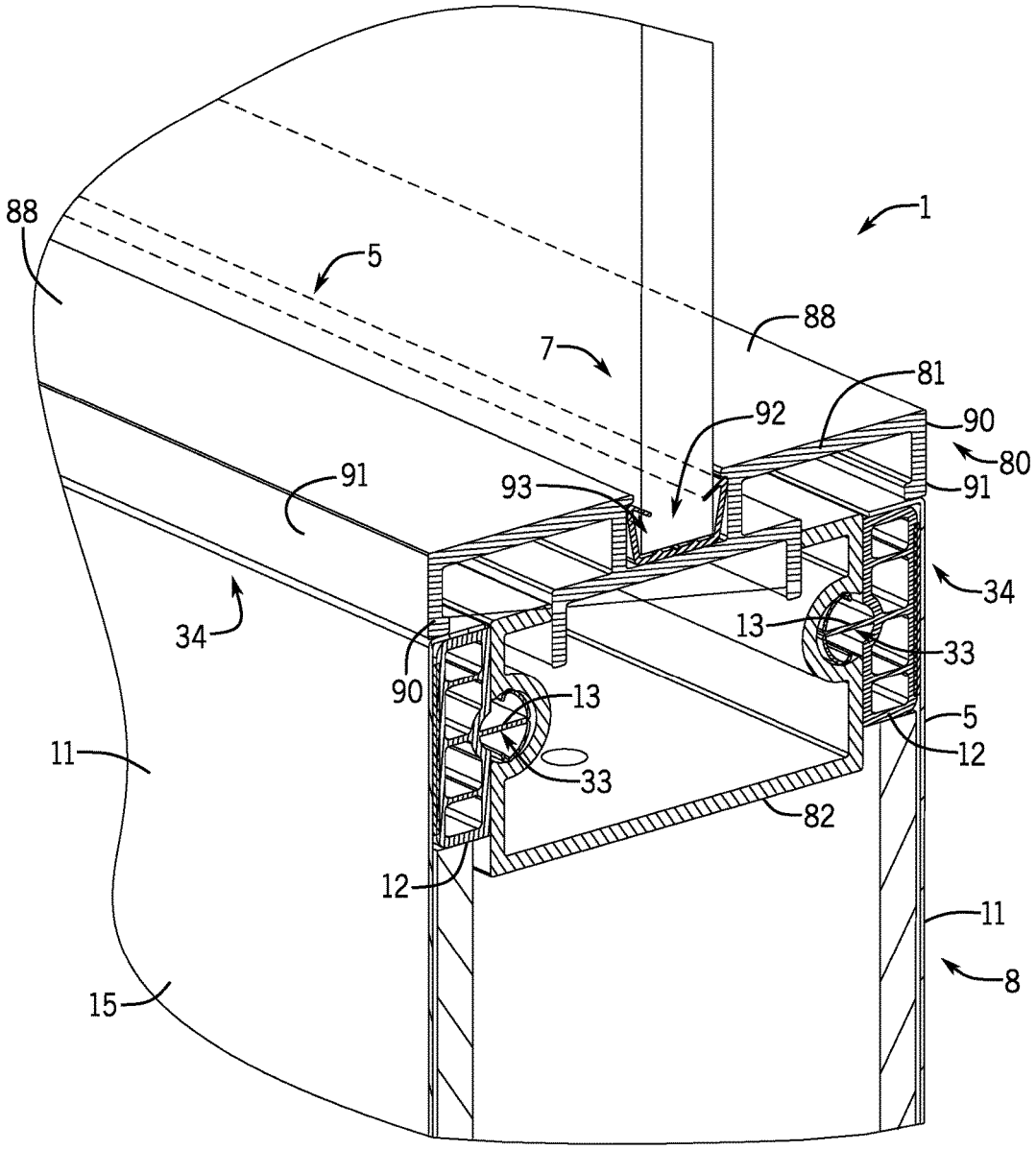
FIG. 12 is a perspective cross sectional view along line 12-12 of FIG. 3 showing a panel transition beam.
Figure 13:
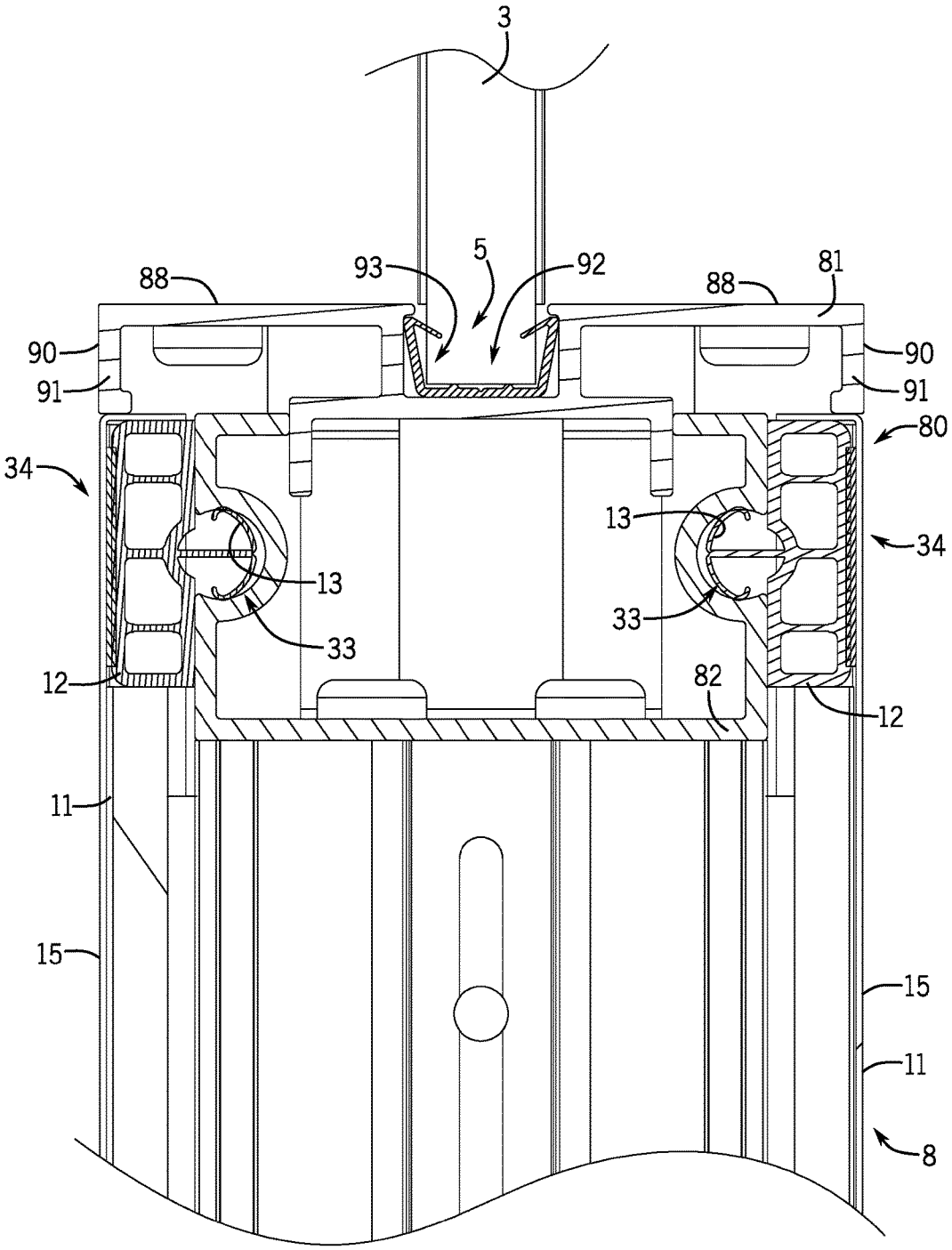
FIG. 13 is a side view like FIG. 12.

Referring to FIGS. 12-13, the wall system 1 includes a transition beam 80 that is disposed between the panel 3 and the panel assembly 8. The panel transition beam 80 is configured to couple the lower end 5 of the panel 3 to the upper end 34 of the panel assembly 8. The transition beam 80 extends along the length of the lower end 5 of the panel 3 and the upper end 34 of the panel assembly 8. The transition beam 80 can be coupled to the terminal column 40, the transition column 50, adjacent panels 3, and/or adjacent panel assemblies 8. The transition beam 80 can be made from any suitable material such as metal, ceramic, plastic, and/or the like.

The panel transition beam 80 has a first member 81 that couples to the panel 3 and a second member 82 that couples to the panel assembly 8. The first member 81 includes at least one upper finished surface 88, at least one facing member 90, and a facing surface 91 configured to be coplanar with an outer surface 15 of the cladding panel 11 (see FIG. 13). The first member 81 defines a channel 92 that is configured to receive the lower end 5 of the panel 3 and/or a gasket 93 that couples to the lower end 5 of the panel 3 (note the channel 92 and the gasket 93 are similar to the channel 52 and the gasket 54, respectively).

The second member 82 defines at least one engagement channel 33 that is configured to receive and/or couple with the rail projection 13 of the cladding panel 11 (similar to the engagement channels 33 described with respect to the substructure 16). The first member 81 and the second member 82 may be pre-assembled (i.e. the first member 81 is coupled to the second member 82 before coupling the transition beam 80 to the panel 3 and/or the panel assembly 8). FIG. 13 exemplifies the features that are visible when the wall system 1 is fully assembled. The visible features include the panel 3, the outer surface 15 of the cladding panel 11, the facing surface 91 of the first member 81, the upper finished surfaces 88 of the first member 81, and the side surface 62 of the cover 60.

Figures 14A, 14B, 14C:
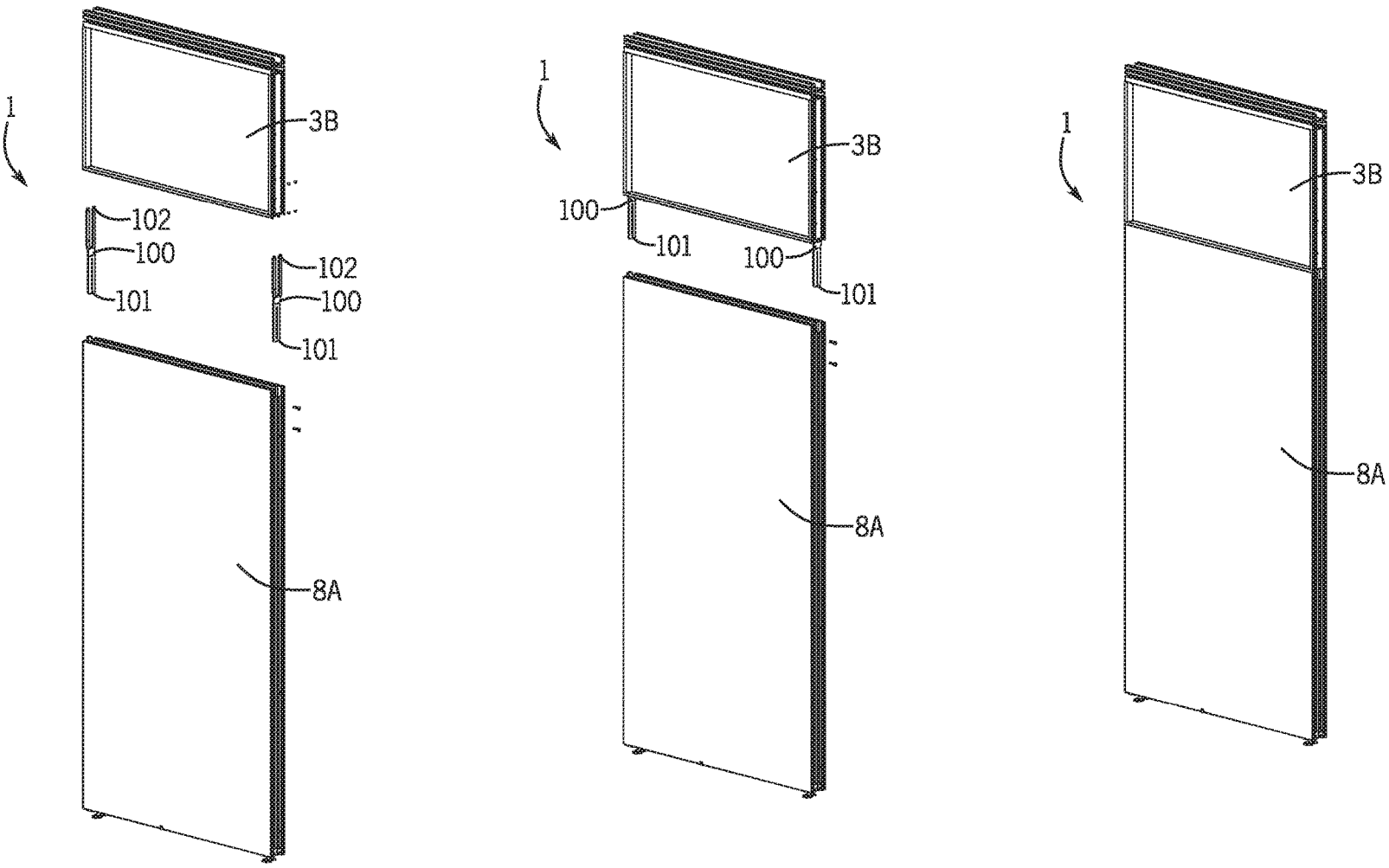
FIGS. 14A-14C depict an example assembly sequence of assembling an alternative example of the wall system.

FIGS. 14A-14C depict an example assembly sequence for an alternative example of the wall system 1. Fastener devices 100 are included and configured to couple panels or panel assemblies to each other. The fastener device 100 has a first end 101 that engages with a first panel assembly 8A and a second end 102 opposite the first end 101 that engages with a second panel 3B (FIGS. 14A-14B) such that the panels are coupled together in a stacked orientation (FIG. 14C). Any type of panel 3 or panel assembly 8 described herein can be utilized with this example wall system 1.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A wall system comprising;

a glass panel having a lower end, a first side end and a second side end;

a panel assembly having an upper end;

a transition beam coupled to the upper end of the panel assembly, wherein the transition beam includes a channel sized to receive the lower end of the glass panel such that the transition beam couples the glass panel to the panel assembly;

a first transition column coupled to the transition beam and including a first channel that receives the first side end of the glass panel; and a second transition column coupled to the transition beam and spaced apart from the first transition column, the second transition column including a second channel that receives the second side end of the glass panel, wherein the first and second transition columns each include a pair of support beams positioned adjacent to each other, wherein each pair of the support beams includes one of the first and second channels, wherein the pair of support beams that form the first and second transition columns each receive a first L-shaped cover and a second L-shaped cover, wherein the first and second L-shaped covers are positioned on opposite sides of the glass panel.

2. The wall system according to claim 1, wherein the panel assembly includes a cladding panel having a rail projection; and wherein the transition beam defines an engagement channel that receives the rail projection such that the cladding panel mounts to the transition beam.

3. The wall system according to claim 1, wherein the panel includes an upper end opposite the lower end, further comprising a cap that couples to the upper end of the panel.

4. A wall system comprising:

a first glass panel having an upper end, a lower end opposite the upper end, a first side end, and a second side end opposite the first side end;

a first panel assembly having an upper end, a first side end, and a second side end opposite the first side end;

a first transition beam that couples to the upper end of the first panel assembly and defines a channel that receives the lower end of the first panel;

a first transition column that couples to the first transition beam, the first transition column including a pair of support beams positioned adjacent to each other where one of the pair of support beams defines a first channel that receives the first side end of the first glass panel;

a second transition column that couples to the first transition beam and is spaced apart from the first transition column, the second transition column including a pair of support beams positioned adjacent to each other where one of the pair of support beams defines a second channel that receives the second side end of the first glass panel;

a first L-shaped cover received on the first transition column and a second L-shaped cover received on the first transition column, wherein the first and second L-shaped covers are positioned on opposite sides of the glass panel; and a third L-shaped cover received on the second transition column and a fourth L-shaped cover received on the second transition column, wherein the third and fourth L-shaped covers are positioned on opposite sides of the glass panel.

5. The wall system according to claim 4 wherein the first panel assembly includes a cladding panel having a first engagement projection; and wherein the first transition beam further defines an engagement channel that receives the first engagement projection to thereby couple the cladding panel to the first transition beam.

6. The wall system according to claim 5, wherein the cladding panel includes a second engagement projection; and wherein a terminal column defines an engagement channel that receives the second engagement projection to thereby couple the cladding panel to the terminal column.

7. The wall system according to claim 5, wherein the cladding panel has an outer surface; and wherein the first transition beam comprises a facing surface that is coplanar with the outer surface of the cladding panel.

8. The wall system according to claim 4, further comprising:

wherein one of the pair of support beams of the second transition column further defines a third channel opposite the second channel;

a second glass panel having an upper end, a lower end opposite the upper end, a first side end that is received in the third channel of the second transition column, and a second side end opposite the first side end;

a second panel assembly having an upper end, a first side end that couples to the second side end of the second panel, and a second side end opposite the first side end;

a second transition beam that couples to the upper end of the second panel assembly and defines a channel configured to receive the lower end of the second glass panel; and a third transition column coupled to the second transition beam and spaced apart from the second transition column, the third transition column including a pair of support beams positioned adjacent to each other where one of the pair of support beams defines a fourth channel configured to receive the second side end of the second glass panel.

9. The wall system according to claim 8, wherein the second panel assembly includes a cladding panel having a first engagement projection; and wherein the second transition beam further defines an engagement channel that is configured to receive the first engagement projection to thereby couple the cladding panel of the second panel assembly to the second transition beam.

10. The wall system according to claim 9, further comprising a third panel assembly that couples to the third transition column and the second side end of the second panel assembly.

11. The wall system according to claim 10, wherein the third panel assembly includes a plurality of cladding panels having outer surfaces that are coplanar.

* * * * *